US006524127B2

(12) United States Patent
Turek et al.

(10) Patent No.: US 6,524,127 B2
(45) Date of Patent: Feb. 25, 2003

(54) INSULATION DISPLACEMENT CONNECTOR WITH REVERSED BEVEL CUTTING EDGE CONTACTS

(75) Inventors: James A. Turek, LaGrange, IL (US); Kenneth G. Irish, Chicago, IL (US)

(73) Assignee: Illinois Tool Works, Glenview, IL (US)

( * ) Notice: Subject to any disclaimer, the term of this patent is extended or adjusted under 35 U.S.C. 154(b) by 12 days.

(21) Appl. No.: 09/883,575

(22) Filed: Jun. 18, 2001

(65) Prior Publication Data

US 2002/0192997 A1 Dec. 19, 2002

(51) Int. Cl.[7] ..... H01R 4/24; H01R 4/26; H01R 11/20

(52) U.S. Cl. ..... 439/404; 439/396; 439/389

(58) Field of Search ..... 439/404, 389, 439/391, 395, 396, 397, 405

(56) References Cited

U.S. PATENT DOCUMENTS

| | | | | |
|---|---|---|---|---|
| 2,333,266 A | | 11/1943 | Miller | |
| RE31,132 E | | 1/1983 | Hoppe, Jr. | |
| 4,427,251 A | | 1/1984 | Mathe et al. | |
| 4,455,057 A | * | 6/1984 | Mariani | 439/424 |
| 4,593,963 A | | 6/1986 | Endo et al. | |
| 4,655,528 A | * | 4/1987 | Groft | 439/404 |
| 4,940,425 A | | 7/1990 | Hass et al. | |
| 4,975,077 A | | 12/1990 | Kato et al. | |
| 5,022,868 A | * | 6/1991 | Legrady | 439/399 |
| 5,030,132 A | | 7/1991 | Hayes et al. | |
| 5,030,143 A | | 7/1991 | Hatagishi | |
| 5,057,033 A | | 10/1991 | Nadin | |
| 5,380,218 A | | 1/1995 | Yamamoto et al. | |
| 5,458,502 A | | 10/1995 | Joly | |
| 5,651,691 A | * | 7/1997 | Grumel | 439/395 |
| 5,836,782 A | | 11/1998 | Odley et al. | |
| 5,921,790 A | | 7/1999 | Nieminen et al. | |
| 5,997,336 A | | 12/1999 | Yamamoto et al. | |
| 6,007,366 A | | 12/1999 | Torii et al. | |

* cited by examiner

*Primary Examiner*—Brian Sircus
*Assistant Examiner*—Chandrika Prasad
(74) *Attorney, Agent, or Firm*—Welsh & Katz, Ltd.; Paul F. Donovan; Mark W. Croll

(57) ABSTRACT

An insulation displacement connector is adapted to receive an associated cable having a conductor and a covering over the conductor and secure the cable within the connector. The connector includes at least one contact. Each contact has at least one wall having a slot formed therein and defining bifurcated wall sections. The slot defines an entrance between the bifurcated wall sections. Each wall section has an outwardly inclined surface defining a reversed bevel that is contiguous with an inwardly inclined surface extending into the slot. The outwardly inclined surfaces each having a cutting edge formed thereon. A juncture of the inwardly inclined surface and its contiguous outwardly inclined surface defines an apex.

24 Claims, 2 Drawing Sheets

INSULATION DISPLACEMENT CONNECTOR WITH REVERSED BEVEL CUTTING EDGE CONTACTS

BACKGROUND OF THE INVENTION

Insulation displacement connectors are well known for connecting electrical cables to all types of components. These connectors provide for ready connection of the cable to the connector, and thus electrical connection to the component, without stripping the cable insulation, soldering the cable or the like.

A typical insulation displacement connector includes an arrangement by which the insulation of the cable is severed or cut to provide direct contact between contacts of the connector and the conductor carried in the cable. The insulation is cut or severed so as to minimize any cutting of the cable.

Typically, a connector includes a plastic or like polymeric body or housing that carries one or more electrical contacts. The plastic body material is an insulating material. In one conventional connector arrangement, each contact includes an elongated slot having substantially flat, opposing side walls. At an upper end of the slot, the walls are tapered inwardly from the entrance of the slot so that as the cable is urged into the slot it traverses through a narrowing or converging portion of the slot upper end. In some known contacts, the inwardly directed edges at the entrance can be coined, that is they can be provided with edges, to facilitate cutting the insulator. The remainder of the slot walls (i.e., below the entrance) are generally configured with flat surfaces (that is non-coined surfaces) to prevent otherwise cutting the conductor. Other known contacts include a flat surface at the angled or tapered entrance region.

One drawback common to all of the known connectors is that as the cable insulation thickness increases, the force required to properly install or insert the cable increases. That is, the thicker the insulation, the greater the force required to insert the cable to the required depth in the contact. This is particularly true with higher voltage cables, such as 600 volt rated cables, which typically include a thicker insulation as required by code.

This added force has two drawbacks. First, the connector body, which is typically plastic, must support the contact load during cable insertion. Excessive insertion forces can damage the connector body or the contact itself, thus rendering the connector useless. Second, the excessive force required to cut the thicker insulation can in turn urge the contact beams apart prematurely, thus minimizing the required electrical contact between the contact and the conductor. That is, the contact slot, which accepts the wire, is spread wider than necessary by the cable cutting force so that the contact minimally engages the conductor. This can result in less than desired, or possibly no contact between the connector contact and the conductor, again, rendering the connector useless.

Accordingly, there is a need for an insulation displacement connector that includes contacts that provide electrical connection between the contacts and an associated electrical cable. Desirably, such a contact is configured to reduce the force necessary to urge the electrical cable into the contact. Most desirably, such connector contacts are configured such that they do not compromise the integrity of the electrical conductor carried within the cable. In such a contact, a counterbalancing force is exerted on the contact as the cable is urged therein so that the force exerted during insertion does not over stress the conducting portions of the contact and the connector carrying the contact.

SUMMARY OF THE INVENTION

A reversed bevel cutting edge insulation displacement connector is adapted to receive an associated cable having a conductor and a covering, i.e., insulation, over the conductor. The connector includes at least one and preferably multiple contacts, each of which is configured to secure the cable therein, slit or cut the cable insulation and provide electrical contact between the conductor and the contact.

A present insulation displacement connector provides electrical connection between the contact and an associated electrical cable, and is configured to reduce the force necessary to urge the electrical cable into the contact. Cutting edges are provided that do not compromise the integrity of the electrical conductor carried within the cable. Moreover, in the present reversed bevel connector contact, a counterbalancing force is exerted on the contact as the cable is urged therein, so as to reduce the opportunity to over stress the cutting portions of the contact and the connector housing the contact.

The contact includes at least one wall, and preferably a pair of walls opposing one another. The walls can be connected to each other by an intermediate connecting section. Each wall has a slot formed therein that defines bifurcated wall sections or beams. Each slot further defines an entrance between the bifurcated wall sections. The slots of each wall align with one another.

Each wall section has an outwardly inclined surface that defines a reversed bevel that is contiguous with an inwardly inclined surface extending into the slot. The outwardly inclined surfaces each having a cutting edge formed on the reversed bevel. A juncture of the inwardly inclined surface and its contiguous outwardly inclined surface defines an apex.

The slot can be formed from the entrance having an elongated contacting region and an end region. Preferably, the contacting region can be defined by opposing slot walls that taper away from one another and the end region can be defined by opposing slot walls that taper toward one another. The contacting region and end region are contiguous with one another. In addition, the outward taper of the slot walls reduces the "spread" of the beams from one another when the cable is inserted into the contact. In this manner, the cable is secured in the connector slot when installed.

For additional rigidity, the connector can be formed such that the walls have outer edges that taper outwardly from a juncture of the outwardly inclined surfaces at the cutting edges and the outer edges. The outward taper provides a space or buffer between the beams and the connector housing to reduce the opportunity for contact between the contact an the connector housing and possible damage to either or both.

In a most preferred configuration, a distance between the apexes is greater than a greatest width of the slot. In the most preferred configuration, all of the surfaces other than the cutting edges are substantially flat surfaces. Because of the reversed bevel of the cutting edges, the insulation is cut away from the conductor, rather than toward the conductor Other features and advantages of the present invention will be apparent from the following detailed description, the accompanying drawings, and the appended claims.

BRIEF DESCRIPTION OF THE FIGURES

The benefits and advantages of the present invention will become more readily apparent to those of ordinary skill in the art after reviewing the following detailed description and accompanying drawings, wherein.

DETAILED DESCRIPTION OF THE INVENTION

Figure 1:
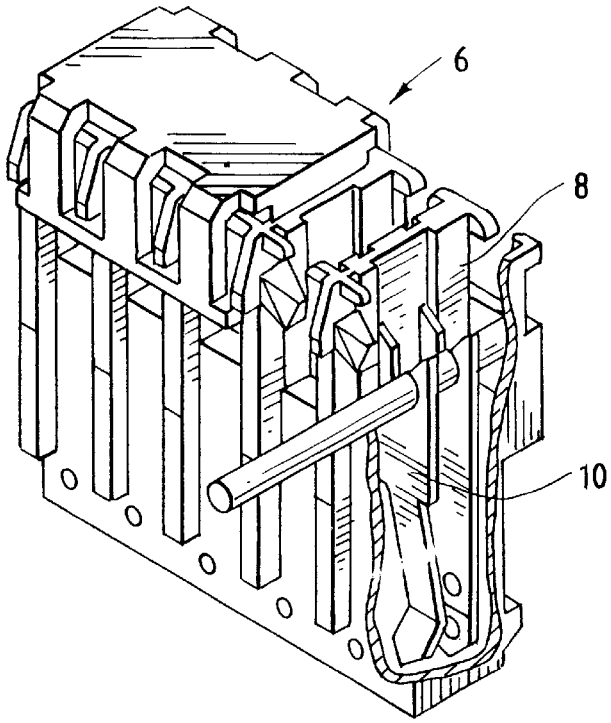
FIG. 1 is a perspective view, shown partially broken away, of an exemplary insulation displacement connector shown with a reversed tapered beveled cutting edge contact therein, embodying the principles of the present invention.

While the invention is susceptible to various embodiments, there is shown in the drawings and will hereinafter be described a specific embodiment with the understanding that the present disclosure is to be considered an exemplification of the invention and is not intended to limit the invention to the specific embodiment illustrated and described.

It is to be further understood that the title of this section of the specification, namely, "Detailed Description of the Invention," relates to a requirement of the United States Patent and Trademark Office, and does not imply, nor should be inferred to limit the subject matter disclosed herein and the scope of the present invention.

Figure 2:
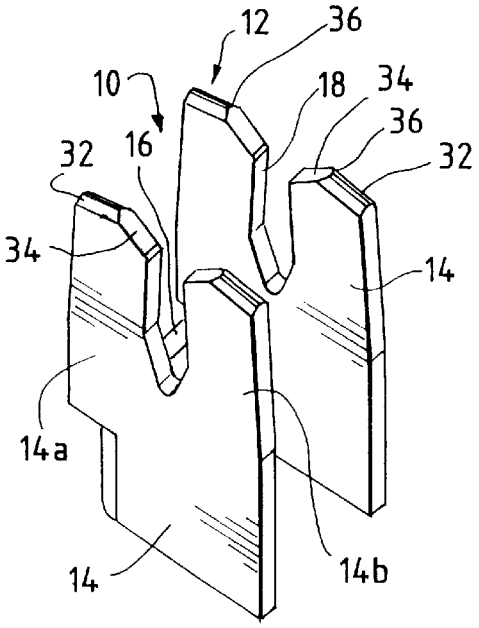
FIG. 2 is a perspective view of a portion of the insulation displacement connector contact having the reversed tapered bevel.
Figure 3:
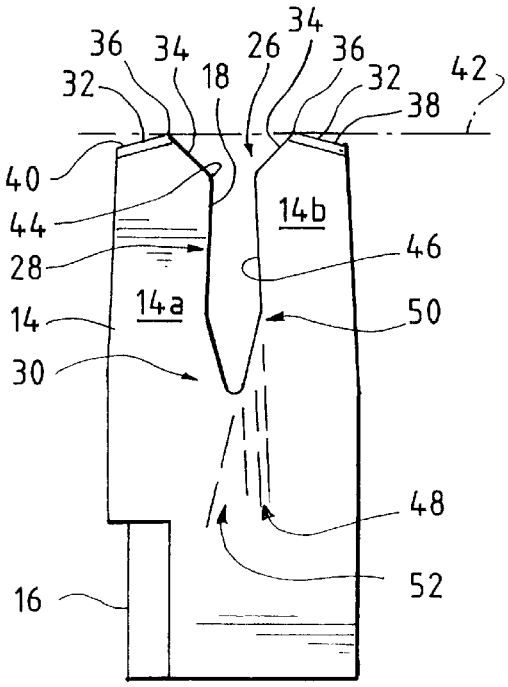
FIG. 3 is a front view of the contact of FIG. 2.

Referring now to the figures and in particular to FIGS. 1–3, there is shown an insulation displacement connector 6 having a body 8 that carries one or more contacts 10. Each contact 10 has reversed beveled cutting edges, indicated generally at 12, embodying the principals of the present invention. Each contact 10 includes at least one and preferably a pair of connector walls 14. An intermediate section 16 connects the walls 14.

Each wall 14 is formed with an elongated slot 18 therein that is configured for receiving a cable 20. As will be recognized from the figures, the walls 14 are configured such that the slots 18 are aligned with one another when the cable 20 is received in the slots 18. In this manner, the cable 20 goes into the slots 18 in both walls 14 and remains substantially straight, that is, unbent as it positioned in the connector 6.

Figure 5:
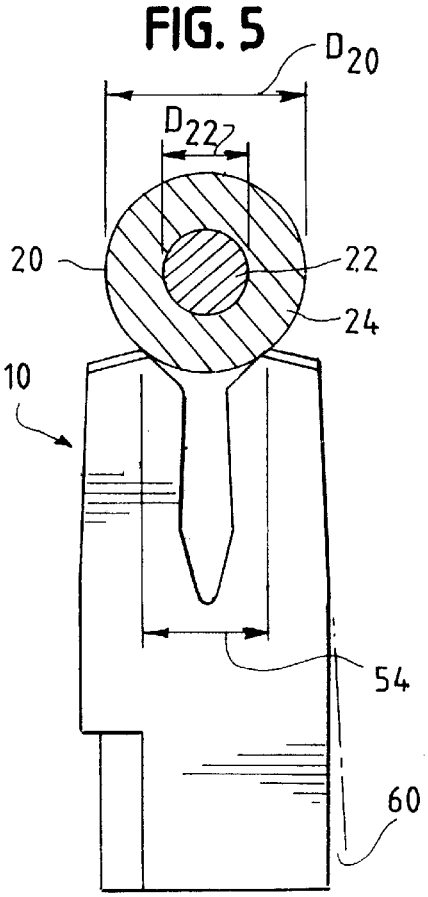
FIG. 5 is a schematic illustration showing a cable as it is urged into the contact.

Referring to FIG. 5, the cable 20 includes a conductor 22 and an outer insulating coating, or insulation 24. Those skilled in the art will recognize that as the rating of a particular cable 20 is increased (that is as the voltage rating of the cable 20 is increased), the thickness of the insulation 24 typically increases as well. Thus, a cable that is rated for 600 volts typically has thicker insulation 24 than a comparable cable having a rating of, for example, 220 volts. Many appliance cables are in fact 600 volt rated cables. As such, the insulation 24 on these cables 20 can be quite thick and the cables 20 can be difficult to install in many known connectors.

The contacts 10 of the connector 6 are configured to accommodate these higher voltage cables 20 without undue force required to urge the cable 20 into the contact 10. Each wall 14 of the contact 10 includes the elongated slot 18 which has an entry region 26, an elongated contacting region 28 and an end region 30. The slot 18 bifurcates the wall 14 to define sections or beams 14*a,b* at the entry 26 and through the contacting region 28 for receiving and engaging the cable 20.

At the entry 26, each beam 14*a,b* has an uppermost outwardly inclined or angled surface 32 and an inwardly inclined or angled surface 34. Each of the contiguous outwardly inclined surfaces 32 and inwardly inclined surfaces 34 terminate at an apex 36.

Figure 4:
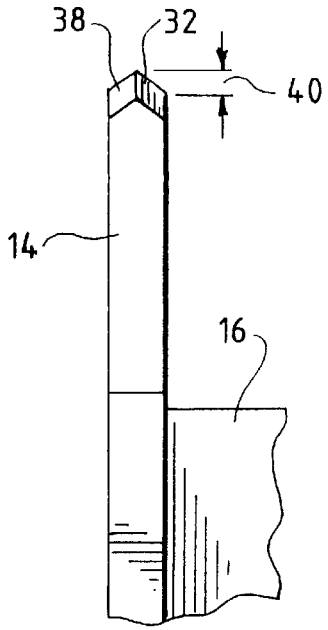
FIG. 4 is a side view of the contact of FIG. 2, showing one wall of the contact.

The outwardly inclined surfaces 32 define a reversed bevel, and are formed having a coined or chamfered cutting edge 38. The reversed bevel is shown in FIG. 3, as indicated at 40, as against a straight line 42 extending between the apices 36. To this end, the outwardly inclined surfaces 32 provide a cutting edge for cutting into or slitting the cable insulation 24 on either side of the conductor 22. The inwardly inclined surfaces 34 are formed as substantially flat walls to prevent any undesirable cutting of the electrical conductor 22. FIG. 4 illustrates best the cutting edge 38, as well as the reversed bevel 40.

The inwardly inclined surfaces 34 terminate at a throat 44 of the slot 18. From the throat 44, the slot surfaces 46 angle or taper slightly outwardly, as indicated at 48 to a base region 50. At the base region 50, the slot 18 again tapes inwardly, as indicated at 52, into the end region 30.

Figure 6:
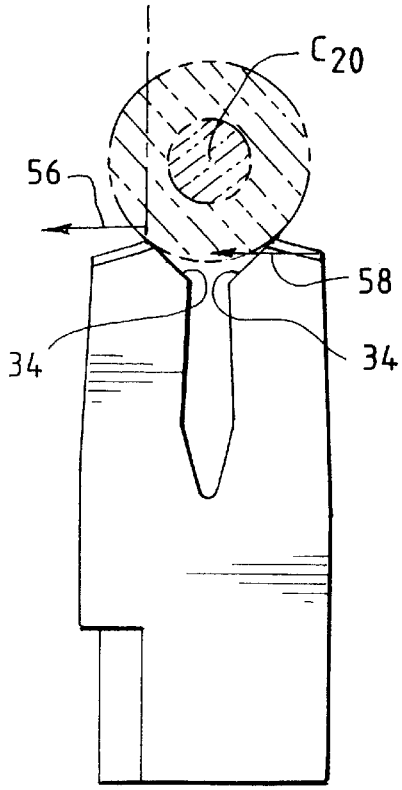
FIG. 6 is a schematic illustration similar to FIG. 5 showing the cable in phantom lines and showing force arrows for expository purposes.

Referring to FIGS. 5–6, the present contact 10 provide a number of advantages and enhancements over known connector contacts. First, it is to be understood that connectors 6 and the contacts 10 carried thereby are generally sized so that the distance between the contact apices 36, as indicated at 54, is less than the diameter $D_{20}$ of the cable 20 but greater than the diameter $D_{22}$ of the electrical conductor 22. This, as will be described below, prevents inadvertently cutting into the conductor 22 when the cable 20 is urged into the contact slot 18.

As the cable 20 is positioned on the contact 10, the apices 36 align the cable 20 over the slot 18. As the cable 20 is urged downwardly into the slot 18, the apices 36 provide a first point of contact and a first cutting edge for slitting the insulation 24.

Continued downward urging of the cable 20 slits or cuts the insulation 24 in an outward direction as indicated at 56, relative to the centerline $C_{20}$ of the cable 20. Thus, as the cable 20 is urged downwardly into the slot 18, rather than compressing the entirety of the cable 20 across the insulation 24 through the throat 44, the insulation 24 is cut so that there is less insulation thickness residing within the slot 18.

It will be appreciated from the figures that rather than cutting a compressed portion of the insulation 24 (that portion of the insulation 24 between the inwardly inclined surface 34), the cutting edges 38 contact the insulation 24 outside of this compressed area and essentially cut the insulation 24 in tension, rather than compression.

In addition, unlike known contacts in which an outward force only is exerted on the wall sections as the cable is urged into the slot, in the present contact 10, because of the reversed bevel 40 of the cutting edges 38, there is also an inward force that is exerted on the beams 14*a,b* when the cable 20 is urged into the slot 18, as indicated by the arrows at 58. In this manner, rather than possibly bending the beams 14*a,b* away from one another as the cable 20 is urged downwardly, there is a counterbalancing force 58 that is exerted inwardly, that assists in overcoming the outward force generated by the downward pressure applied by the cable 20 on the beams 14*a,b*. As such, there is less tendency to bend the beams 14*a,b* outwardly away from one another.

As will be recognized by those skilled in the art, if these beams or wall sections 14*a,b* are bent too far from each other, less than acceptable contact (or possibly no contact) between the contact 10 and the conductor 22 can occur. Thus, it has been observed that the present contact 10 provides enhanced electrical contact between the contact 10 and the conductor 22.

The slight outward taper 48 of the slot 18, beyond the throat section 44, also reduces the tendency to over-bend the beams 14*a,b* outwardly. As will be appreciated from the figures, because the distance between the surfaces in the contacting region 28 increases beyond the throat 44, there is less force exerted (and thus less stress) on the beams 14*a,b* as the cable 20 is urged beyond the throat 44, and into the slot 18. As will be recognized, as the cable 20 is urged into the slot 18, the beams 14*a,b* will bend outwardly. However, because of the taper 48, as the beams 14*a,b* bend, the slot surfaces 46 will tend to become parallel to one another (rather than converging or diverging). It has been found that the parallel surfaces 46 provide a greater "grip" on the fully inserted cable 20, as compared to contacts in which the surfaces have substantially converging or diverging profiles. Within the end region 30, the inward taper 52 secures the cable 20 within the contact 10 to ensure proper engagement between the contact 10 and cable 20, and to reduce the opportunity for the cable 20 to dislodge therefrom.

Additionally, the contact 10 can be formed such that the beams 14*a,b* can be slightly tapered on an outside surface thereof, as indicated generally at 60 in FIG. 5. These outwardly tapered surfaces 60 provide a number of benefits. First, as the beams 14*a,b* are flexed or bent outwardly (by cable 20 insertion), the tapers 60 provide a space or buffer so that the beams 14*a,b* do not, or minimally contact the plastic connector body 8. This is particularly advantageous when the cable 20 has a relatively thick insulation which can cause considerable contact beam 14*a,b* "spread". Again, as will be recognized by those skilled in the art, because there is a greater space between the beams 14*a,b* and the connector body 8, there is less opportunity to damage either the beams 14*a,b* or the connector body 8, as a result of overstressed conditions. In addition, this configuration provides additional rigidity to the beams 14*a,b* against the outward bending force.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the invention. It is to be understood that no limitation with respect to the specific embodiment illustrated is intended or should be inferred. The disclosure is intended to cover by the appended claims all such modifications as fall within the scope of the claims.

What is claimed is:

1. An insulation displacement connector adapted to receive an associated cable having a conductor and a covering over the conductor, the cable having a diameter and the conductor, which is within the cable, having a diameter less than that of the cable, the connector comprising:

a body, and at least one contact carried by the body, the at least one contact having at least one wall having a slot formed therein defining bifurcated wall sections, the slot further defining an entrance therein between the bifurcated wall sections, each wall section having an outwardly inclined surface defining a reversed bevel contiguous with an inwardly inclined surface extending into the each outwardly inclined surfaces defining a cutting edge formed thereon, each cutting edge being oriented radially relative to a cable inserted into the connectors a juncture of the inwardly inclined surface and its contiguous outwardly inclined surface defining an apex.

2. The insulation displacement connector in accordance with claim 1 wherein the slot is formed from the entrance having a contacting region and an end region.

3. The insulation displacement connector in accordance with claim 2 wherein the contacting region is elongated.

4. The insulation displacement connector in accordance with claim 2 wherein the contacting region is defined by opposing slot walls tapering away from one another.

5. The insulation displacement connector in accordance with claim 2 wherein the end region is defined by opposing slot walls tapering toward one another.

6. The insulation displacement connector in accordance with claim 4 wherein the end region is defined by opposing slot walls tapering toward one another, the contacting region and end region being contiguous with one another.

7. The insulation displacement connector in accordance with claim 1 wherein the wall has outer edges tapering outwardly from an outermost point of the outwardly inclined surfaces and the outer edges.

8. The insulation displacement connector in accordance with claim 1 wherein the at least one contact has two walls connected to one another by an intermediate section.

9. The insulation displacement connector in accordance with claim 8 wherein the slots of each of the walls align with one another.

10. The insulation displacement connector in accordance with claim 1 wherein a distance between the apexes is greater than a greatest width of the slot.

11. The insulation displacement connector in accordance with claim 1 wherein the inwardly inclined surface is a substantially flat surface.

12. The insulation displacement connector in accordance with claim 2 wherein the slot contacting region and end region are substantially flat surfaces.

13. The insulation displacement connector in accordance with claim 1 wherein the body carries a plurality of contacts.

14. An insulation displacement connector adapted to receive an associated cable having a conductor and a covering over the conductor, the cable having a diameter and the conductor, which is within the cable, having a diameter less than that of the cable, the connector comprising:

a body; and at least one contact carried by the body, the at least one contact having a pair of opposing walls connected to one another by an intermediate section, each wall having a slot formed therein defining beams, the slots being aligned with one another, the slots each further defining an entrance from a throat region inwardly of the slot between the beams, each wall section having an outwardly inclined surface defining a reversed bevel contiguous with an inwardly inclined surface extending into the slot, each slot being formed from the entrance having an elongated contacting region and an end region contiguous through the slot, the contacting regions being defined by opposing slot walls tapering away from one another and the end regions being defined by opposing slot walls tapering toward one another, the inwardly inclined surfaces, the contacting regions and the end regions being substantially flat surfaces, wherein each outwardly inclined surface has a cutting edge formed thereon, each cutting edges being oriented radially relative to a cable inserted into the slot, a juncture of the inwardly inclined surface and its contiguous outwardly inclined surface defining an apex.

15. The insulation displacement connector in accordance with claim 14 wherein the walls have outer edges tapering outwardly from an outermost point of the outwardly inclined surfaces at the cutting edges and the outer edges.

16. The insulation displacement connector in accordance with claim 14 wherein a distance between the apexes is greater than a greatest width of the slot.

17. The insulation displacement connector in accordance with claim 14 including a plurality of contacts carried by the body.

18. An insulation displacement connector adapted to receive an associated cable having a conductor and a covering over the conductor, the cable having a diameter and the conductor, which is within the cable, having a diameter less than that of the cable, the connector comprising:

a housing; and at least one contact carried by the housing, the at least one contact having at least one wall, the at least one wall having a slot formed therein defining bifurcated wall sections, the slot further defining an entrance between the bifurcated wall sections for receiving the cable, each wall section having a cutting edge formed therein, each cutting edges being oriented radially relative to a cable insert into the slot, wherein when the cable is urged into the slot, a force is exerted on the cutting edges urging the bifurcated wall sec tons toward one another, inward of the slot.

19. The insulation displacement connector in accordance with claim 18 wherein each cutting edge is formed as a reversed bevel.

20. The insulation displacement connector in accordance with claim 19 wherein each bifurcated wall section includes an inwardly inclined surface extending from an apex into the slot, and wherein each cutting edge forms a side of the apex opposing a respective inwardly inclined surface.

21. The insulation displacement connector in accordance with claim 18 including a pair of walls opposing one another and connected to one another by an intermediate section.

22. The insulation displacement connector in accordance with claim 21 wherein the slots in the walls align with one another.

23. The insulation displacement connector in accordance with claim 18 including a plurality of contacts carried by the housing.

24. The insulation displacement connector in accordance with claim 18 wherein the at least one wall defines an outer surface, and wherein the outer surface is tapered outwardly away from an outermost point of each respective cutting edge.

* * * * *